United States Patent [19]

Mailloux et al.

[11] 4,111,542

[45] Sep. 5, 1978

[54] COLLATING SYSTEM FOR OPAQUE DOCUMENTS AND SLIDE REPRODUCTIONS

[75] Inventors: Louis D. Mailloux, Webster; James E. Bollman, Williamson, both of N.Y.

[73] Assignee: Xerox Corporation, Stamford, Conn.

[21] Appl. No.: 791,261

[22] Filed: Apr. 27, 1977

[51] Int. Cl.[2] ..... G03G 15/00

[52] U.S. Cl. ..... 355/14; 355/11

[58] Field of Search ..... 355/3 R, 14, 11, 66

[56] References Cited

U.S. PATENT DOCUMENTS 4,043,656 8/1977 Cherian ..... 355/11 X

*Primary Examiner*—Richard L. Moses

[57] ABSTRACT

An electrostatographic printing machine in which a plurality of transparencies and at least one opaque original document are reproduced. The transparencies are stored in an ordered sequence and advanced automatically into operative communication with the reproduction system. After a pre-determined number of transparencies have been copied, the opaque original document is reproduced to form an ordered set of copies having copies of the transparencies and opaque original documents.

12 Claims, 4 Drawing Figures

COLLATING SYSTEM FOR OPAQUE DOCUMENTS AND SLIDE REPRODUCTIONS

BACKGROUND OF THE INVENTION

This invention relates to an electrostatographic printing machine, and more particularly concerns a printing machine arranged to reproduce a plurality of transparencies and at least one opaque original document in an ordered sequence.

An electrostatographic printing process involves the formation and utilization of electrostatic latent charge patterns for the purpose of recording and reproducing the patterns in viewable form. The field of electrostatographic printing includes electrographic and electrophotographic printing. Electrophotographic printing is that class of electrostatographic printing which employs a photosensitive medium to form, with the aid of electromagnetic radiation, the electrostatic latent charge pattern. Xerography, which employs infra-red, visible or ultraviolet radiation and xero-radiography are sub-classes of electrophotography. Electrography is that class of electrostatography which utilizes an insulating medium to form, without the aid of electromagnetic radiation, the electrostatic latent charge pattern. Xero-printing which uses the pattern of insulating material on a conductive medium to form electrostatic charge patterns and electrographic recording, which uses a charge transfer between the plurality of electrodes to form directly electrostatic charge patterns, are sub-classes of electrographic printing. In all of the foregoing types of machines, it is highly desirable to be capable of reproducing transparencies as well as opaque original documents. More particularly, it is highly advantageous to provide a plurality of transparencies in an ordered sequence with each transparency being reproduced sequentially so as to produce a set of collated copies. However, it is further advantageous to be capable of interposing selectively opaque original documents within the ordered set of transparencies so as to produce a plurality of sets of copies comprising an ordered arrangement of the transparencies and opaque original documents.

The process of electrophotographic printing will be described hereinafter as an exemplary system for achieving the foregoing. An electrophotographic printing machine exposes a charged photoconductive member to a light image of the transparency or opaque original document being reproduced. The irradiated areas of the photoconductive surface are discharged recording thereon an electrostatic latent image corresponding to the informational areas contained within the transparency or opaque original document. A development system moves a developer mix with carrier granules and toner particles into contact with the photoconductive surface. The toner particles are attracted electrostatically from the carrier granules to the latent image forming a toner powder image thereon. Thereafter, the toner powder image is transferred to a sheet of support material. After transferring the toner powder image from the latent image to the sheet of support material, a fusing device permanently affixes the the toner powder image thereto. The foregoing briefly describes the basic operation of an electrophotographic printing machine. This concept was originally disclosed by Carlson in U.S. Pat. No. 2,297,691 and is further amplified and described by many related patents in the art.

Many special purpose electrophotographic printing machines have been developed and are in wide commercial use. For example, electrophotographic printing machines are presently commercially available for reproducing microfilm. Machines of this type are described in U.S. Pat. No. 3,424,525 issued to Towers et al in 1969; U.S. Pat. No. 3,542,468 issued to Blow, Jr. in 1970; and U.S. Pat. No. 3,547,533 issued to Stokes et al in 1970. In general, a microfilm reproducing machine produces an enlarged copy of a microfilm original. However, high quality reproduction of color slides has also recently been achieved. This process is exemplified by co-pending application Ser. No. 540,617 filed in 1975, and co-pending application Ser. No. 663,389 filed in 1976. As disclosed in the foregoing applications, a light image of a color transparency is projected onto a mirror. The mirror reflects the light image through a screen and field lens onto the charged portion of the photoconductive surface. This light image is filtered to record a single color electrostatic latent image on the photoconductive surface. Successive single color electrostatic latent images are recorded and developed with appropriately colored toner particles. These toner powder images are transferred to a sheet of support material, in superimposed registration with one another. This multi-layer toner powder image is then permanently affixed to the sheet of support material forming a copy of the color slide being reproduced. Improvements in this basic process include positioning a mirror in the path of the transparency light image to direct the light image onto the charged portion of the photoconductive member with the mirror being readily removable from the optical light path so as to reproduce opaque original documents. More recently, it has been found that a ordered set of slides may be reproduced as a plurality of sets of ordered copies. The foregoing is more fully described in co-pending application Ser. No. 701,447 filed in 1976. As disclosed therein, a set of slides is disposed in a slide projector, in an ordered sequence, and automatically indexed to form a plurality of collated sets of copies. However, it is also extremely desirable to be capable of reproducing ordered sets of slides having copies of opaque original documents interleafed therebetween.

Accordingly, it is a primary object of the present invention to improve electrostatographic printing machines by reproducing sets of collated copies from an ordered arrangement of transparencies and opaque original documents.

SUMMARY OF THE INVENTION

Briefly stated, and in accordance with the present invention, there is provided an electrostatographic printing machine for reproducing a plurality of transparencies and at least one opaque original document.

Pursuant to the features of the present invention, the electrostatographic printing machine includes means for storing a plurality of transparencies. Means are provided for supporting at least one opaque original document. Reproducing means form copies of the transparencies and opaque original document. Means advance each transparency into operative communication with the reproducing means in a pre-selected sequence. Switching means switch the reproducing means from the transparency copying mode to the original document copying mode in response to a pre-determined number of transparencies being copied. This forms a set of ordered copies having copies of the transparencies and opaque original documents.

BRIEF DESCRIPTION OF THE DRAWINGS

Other objects and advantages of the present invention will become apparent upon reading the following detailed description and upon reference to the drawings, in which.

Figure 1:
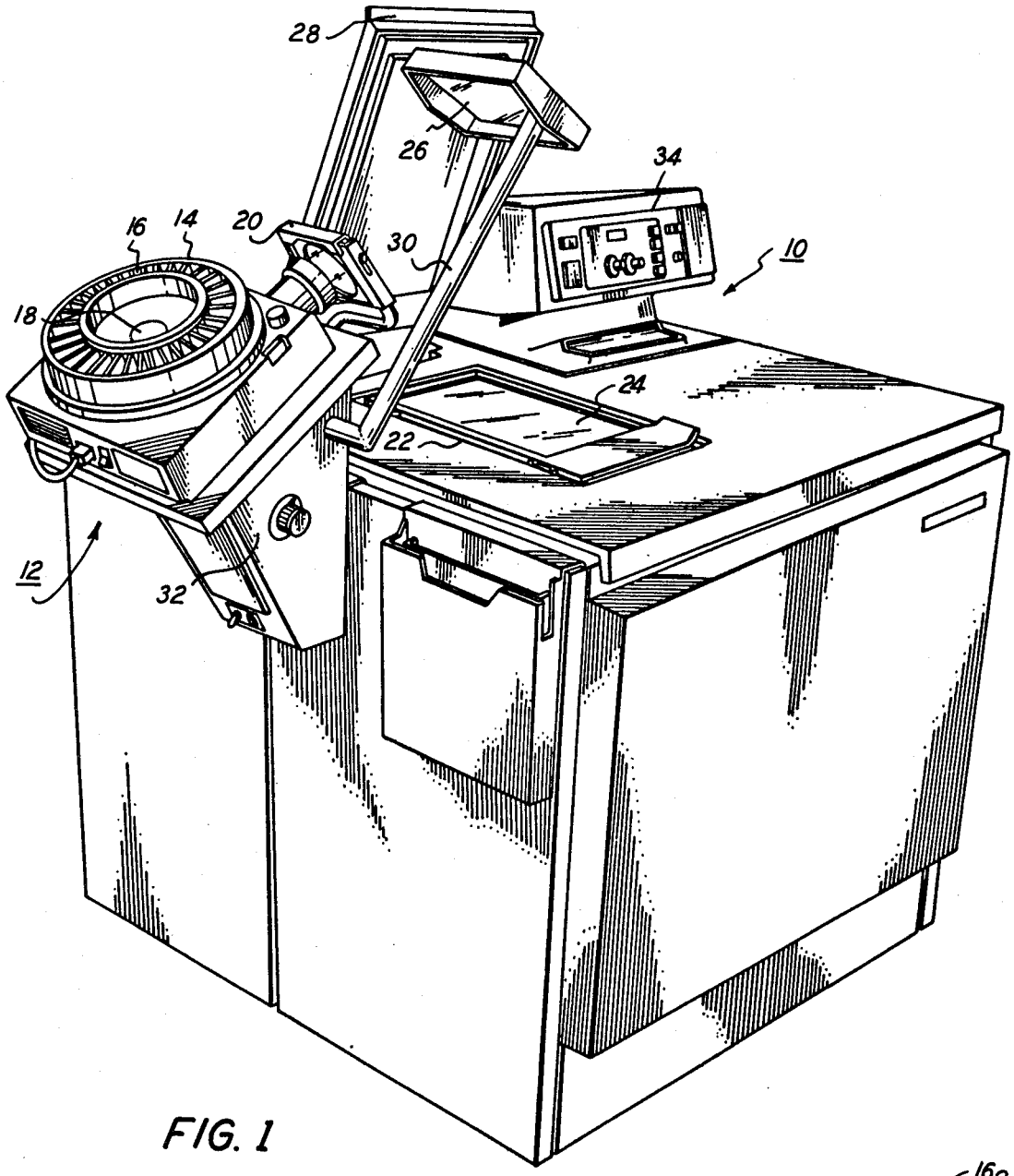
FIG. 1 is a perspective view of an electrophotographic printing machine incorporating the features of the present invention therein.

While the present invention will hereinafter be described in connection with the preferred embodiment thereof, it is understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

For a general understanding of an electrophotographic printing machine incorporating the features of the present invention therein, continued reference is had to the drawings. In the drawings, like reference numerals have been used throughout to designate identical elements. Although the electrophotographic printing machine of the present invention is particularly well adapted for reproducing color transparencies and single or multiple copies of opaque original documents, it should become evident from the following discussion that it is equally well suited for use in a wide variety of applications. For example, producing black and white copies from black and white transparencies or from black and white opaque original documents. Moreover, the printing machine is not necessarily limited to the particular embodiments shown herein. The features of the present invention may be employed in any suitable electrostatographic printing machine and the printing machine shown herein incorporating these features is merely exemplary thereof.

As shown in FIG. 1, the reproducing machine or electrophotographic printing machine indicated generally by the reference numeral 10 has a slide projector 12 mounted thereon. Slide projector 12 includes a cylindrical member 14 having a plurality of compartments 16 therein. Internal to slide projector 12 is an indexing motor. Cylindrical member 14 is mounted on shaft 18 of the indexing motor and rotates therewith. In this manner, after a copy of the transparency or color slide positioned in one of compartments 16 of cylindrical 14 is reproduced, the indexing motor is actuated advancing the cylindrical member to position the next compartment, with the slide therein in communication with the reproducing machine so as to be copied thereby. The printing machine is also adapted to reproduce opaque original documents which are positioned on the platen thereof. Thus, the indexing motor is automatically disabled when the operator desires to interpose an opaque original document between the slides being reproduced. For example, if the operator desires to interpose a copy of an opaque original document in the set of copies being reproduced after the fifth slide, the operator merely dials the number five locating the position of the opaque original document and the indexing motor is disabled at that point. This switches the printing machine from the transparency copying mode to the opaque original document mode. Thereafter, the machine operator disposes the opaque original document on the platen of the printing machine and activates the print button. This produces a copy of the opaque original document in sequence with the transparencies being reproduced. The printing machine automatically switches back to the transparency reproducing mode after the opaque original document has been copied. The foregoing sequence of events is repeated for each set of copies being obtained.

Figure 3:
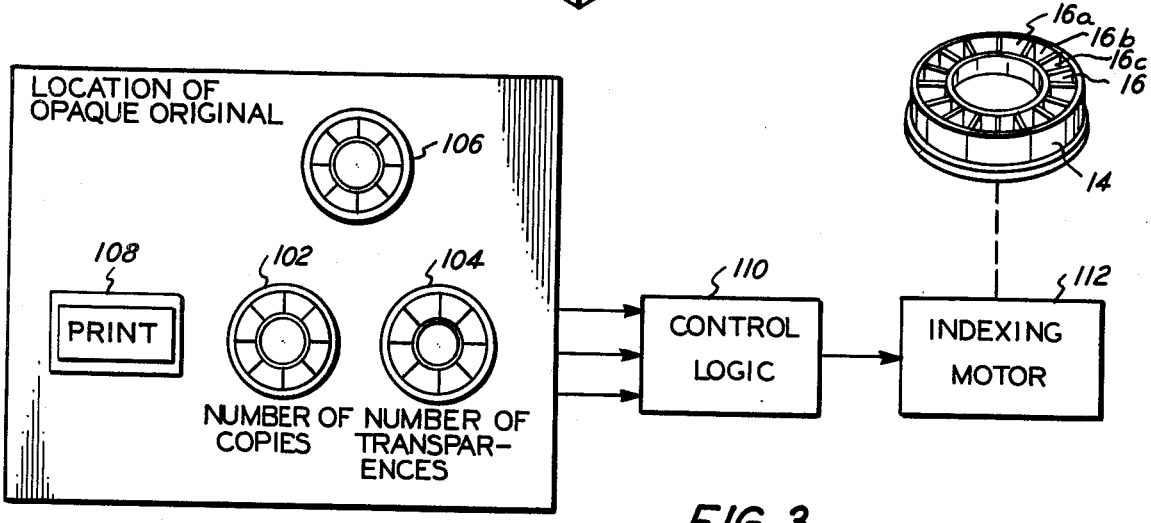
FIG. 3 is an elevational view depicting, with block diagrams, the control system for the FIG. 1 printing machine.
Figure 4:
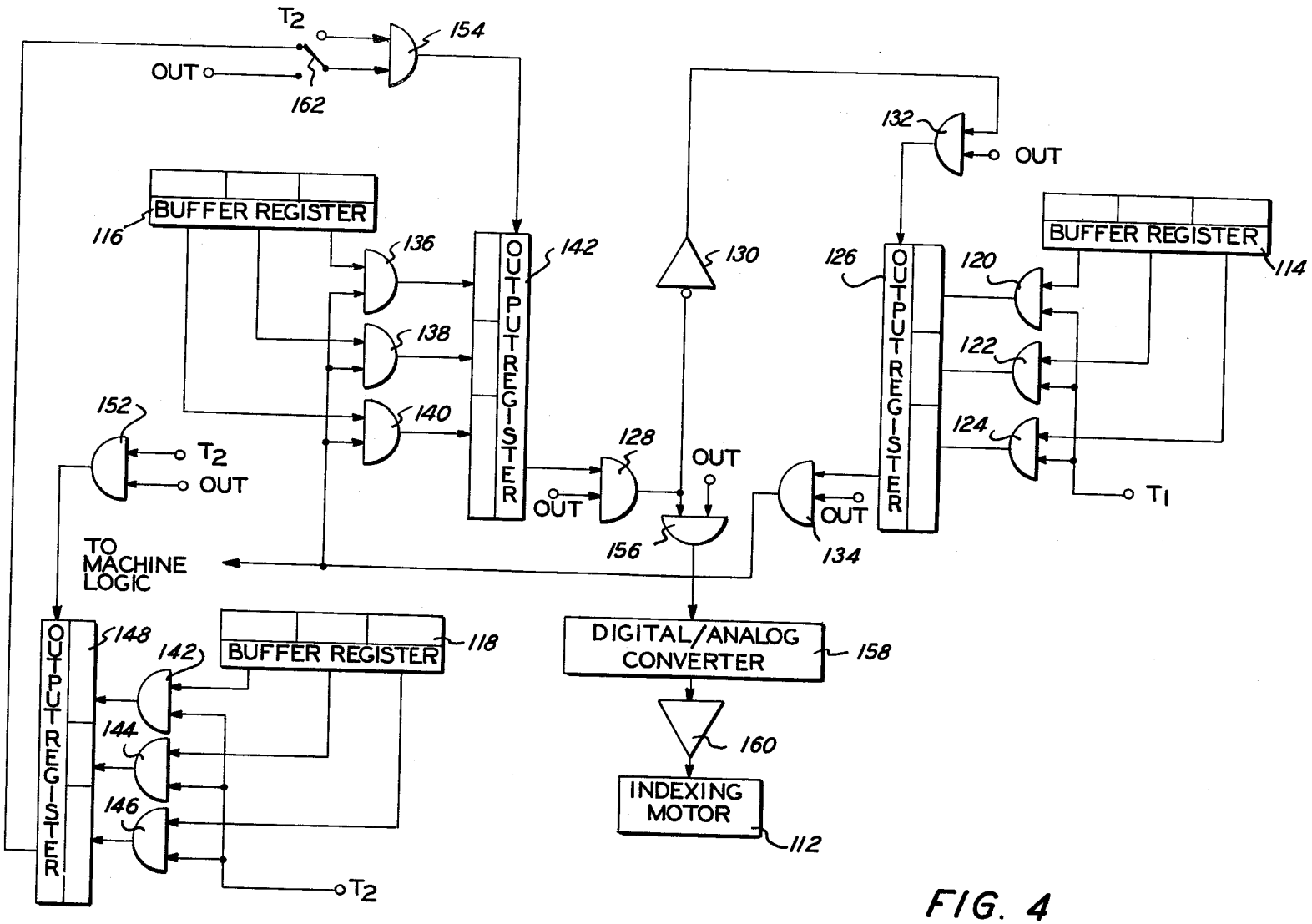
FIG. 4 is a logic diagram showing the FIG. 3 logic.

In the transparency copying mode, slide projector 12 projects a light image of a transparency disposed in one of the compartments obtained through light filter 20 which serves to correct the colors of the printing machine filters. The light image is reflected through screen 22 and field lens or Fresnel lens 24 disposed on the printing machine platen by a mirror 26. As shown in FIG. 1, cover 28 is positioned in the opened position. Contrawise, in the opaque reproduction mode, cover 28 is closed, i.e. in contact with the opaque original document disposed on the printing machine platen, with screen 22 and field lens 24 being removed therefrom. The foregoing is achieved by pivoting mirror 26 from the operative position in the optical light path to the inoperative position spaced therefrom. Mirror 26 is mounted rotatably on arm 30. Arm 30, in turn, is mounted pivotally on frame 32 supporting slide projector 12. Thus, arm 30 is rotated to permit cover 28 to be closed when the printing machine is converted from a transparency reproducing machine to an opaque reproducing machine. Control panel 34 includes the requisite controls for indicating the number of copies, the number of transparencies, and the location of the opaque original document being reproduced. The logic circuitry coupling slide projector 12 and its corresponding indexing motor with the reproducing machine 10 is at least partially in control panel 34. A fragmentary schematic control panel 34 illustrating these features is depicted in FIG. 3. The control circuitry associated therewith for indexing the slides and automatically disabling the indexing motor when an opaque original document is being reproduced is depicted in FIG. 4. The various processing stations of the of printing machine is illustrated in FIG. 2.

Figure 2:
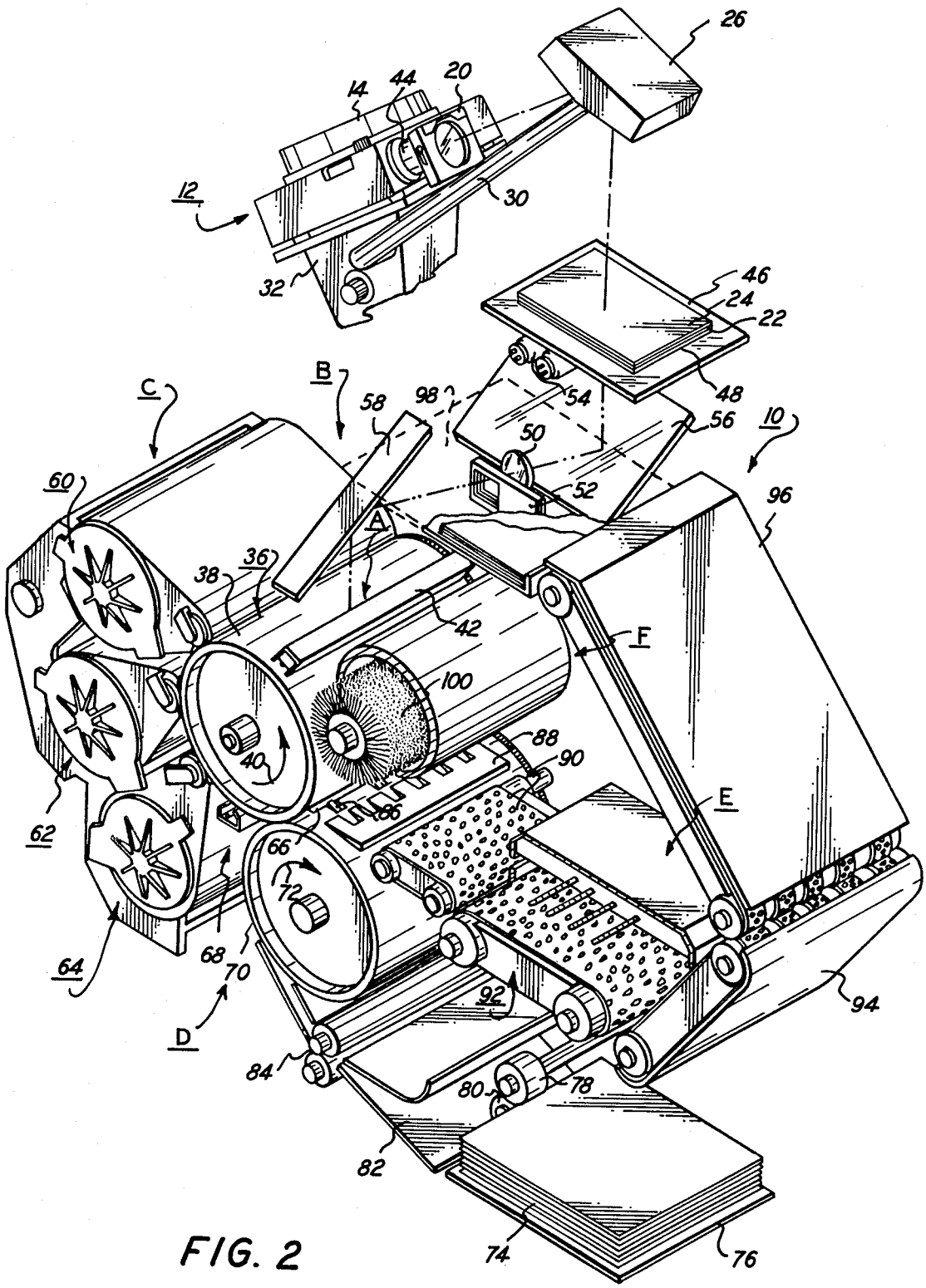
FIG. 2 is a schematic perspective view illustrating the processing stations in the FIG. 1 printing machine.

Turning now to FIG. 2, an illustrative schematic of the printing machine is depicted thereat. Electrophotographic printing machine 10 employs a photoconductive member 10 having a drum 36 mounted rotatably on the printing machine frame (not shown) with photoconductive surface 38 secured thereto and entrained thereabout. Preferably, photoconductive surface 38 is made from a suitable panchromatic selenium alloy such as described in U.S. Pat. No. 3,655,377 issued to Sechak in 1972.

As drum 36 rotates in the direction of arrow 40, a portion of photoconductive surface 12 passes through a series of processing stations located about the periphery thereof. Drum 36 is rotated at a substantially constant angular velocity so that the proper sequencing of events may occur at each of the processing stations. Timing for each event is achieved by a signal generator (not shown) operatively associated with drum 36. The signal generator develops electrical pulses which are processed by the machine logic so that each processing station is activated at the appropriate time during the rotation of drum 10. In addition, these pulses serve to provide timing pulses for the control logic coupling slide projector 12 with reproducing machine 10. One suitable type of signal generator is a disc having a plurality of slits in the periphery thereof mounted on the shaft of drum 36 so as to rotate therewith. Positioned on one side of the disc is a light source, and, located on the other side of the disc, is the photosensor. The disc is opaque and light rays are only transmitted to the photosensor when a slit is interposed between the photosensor and light source. Thus, the photosensor detects periodic pulses of light. The photosensor, in turn, develops electrical pulses corresponding to the sensed light rays which are processed by the machine logic and serve as timing pulses.

Initially, drum 36 rotates through charging station A. At charging station A, a corona generating device, indicated generally by the reference numeral 42, charges at least a portion of photoconductive surface 38 to a relatively high, substantially uniform level. A suitable corona generating device is described in U.S. Pat. No. 3,875,407 issued to Hayne in 1975. After photoconductive surface 38 is charged to a substantially uniform level, drum 38 rotates the charged portion thereof to exposure station B.

At exposure station B, a color filtered light image of the color transparency disposed in compartment 16 of slide projector 12, as exemplified by a 35 mm slide, is projected onto the charged portion of photoconductive surface 38. The indexing motor of slide projector 12 advances the appropriate compartment 16 having a color slide therein to the projection system of slide projector 12. Slide projector 12 includes a light source adapted to illuminate the colored transparency and a lens 44 having an adjustable focus to produce an enlarged or magnified image thereof. Frame 32 supports slide projector 12. Arm 30 has one end thereof mounted pivotably on frame 32. The other end portion is secured rotatably to mirror 20. In this way, arm 30 may be pivoted relative to frame 32 moving mirror 20 out of the path of the transparency light image when an opaque original document is being reproduced. Contrawise, when a transparency is being reproduced, arm 30 is pivoted to position mirror 20 in the path of the transparency light image. Thus, the light image of the transparency is projected from slide projector 12 to mirror 20. Mirror 20 directs the light image through a field lens, such as Fresnel lens 24. Mirror 20 is mounted rotatably on arm 30 so as to be capable of directing the light image in the desired direction, i.e. transmitted through field lens 24. Disposed between field lens 24 and transparent lens 46 is an optional opaque sheet 48 having an aperture therein, i.e. a picture frame or informational frame, which may be considered a composition frame. Composition frame 48 defines an opaque border extending outwardly from the light image of the color transparency. Frame 48 may have indicia inscribed therein. Screen 22 may be disposed beneath field lens 24, i.e. interposed between field lens 24 and composition frame 48. Screen 22 modulates the color transparency light image forming a half-tone light image thereof. A scanning system is disposed beneath platen 46 and includes a moving lens system, designated generally by the reference numeral 50, and a color filter mechanism, shown generally at 52. Lamps 54 move in a timed relationship with lens 50 and filter mechanism 52 to scan an illuminate successive incremental areas of composition frame 48 or of an original document disposed on platen 22. In this manner, a half-tone light image of the color transparency may be combined with the light image of the composition frame to form a combined image. This system also generates a light image of the original document. These light images are transmitted onto the charged portion of photoconductive surface 38 to selectively dissipate the charge thereon and record electrostatic latent images thereof.

In the transparency copying mode, platen cover 28 (FIG. 1) must be pivoted to the opened position permitting arm 30 to rotate so as to locate mirror 20 in the path of the transparency light image. Contrawise, when an opaque original document is being reproduced, arm 30 rotates to a position remote from the path of the transparency light image permitting platen cover 28 to be closed.

With continued reference to FIG. 2, in the transparency copying mode, screen 22 is interposed between composition frame 48 and field lens 24. Slide projector 12 projects the transparency light image onto mirror 20 which reflects it in a downwardly direction to pass through screen 22 so as to be modulated thereby. The resultant light rays are reflected by mirror 56 through lens 50 and filter 52 forming a single color light image. This single color light image is reflected by mirror 58 onto the charged portion of photoconductive surface 38. Thus, the modulated single color light image irradiates the charged portion of photoconductive surface 38 recording a single color electrostatic latent image thereon. Similarly, the light image of an original document irradiates the charged portion of photoconductive surface 38 forming an unmodulated image thereof.

Filter mechanism 52 interposes selected color filters into the optical light path during the exposure process. These filters operate on the light rays transmitted through lens 50 to form a light image corresponding to a single color of the transparency or opaque original document. Preferably, filter mechanism 52 includes a housing which is mounted on lens 50 by a suitable bracket and moves therewith during scanning as a single unit. The housing of filter 52 includes a window which is positioned relative to lens 50 permitting the light rays to pass therethrough. The bottom and top walls of the housing comprise a plurality of tracks which extend the entire width thereof. Each track is adapted to carry a filter permitting movement thereof from an inoperative position to an operative position. In the operative position, the filter is interposed into the window of the housing enabling light rays to pass therethrough. Individual filters are made from any suitable filter material such as coated glass. Preferably, three filters are employed in the electrophotographic printing machine depicted in FIG. 2, a red filter, a blue filter, and a green filter. A detailed description of the filter mechanism is found in U.S. Pat. No. 3,775,006 issued to Hartman et al, in 1973.

Lamps 54 traverse platen 46 to illuminate incremental areas of the original document disposed thereon. In this manner, the light rays from the original document are transmitted through lens 50. Preferably, lens 50 is a six-element split dag or type of lens having front and back compound lens components with a centrally located diaphragm therebetween. It should be noted that the light image of the transparency is also transmitted through the foregoing lens. Lens 50 forms a high quality image with a field angle of about 31° and a speed ranging from f/4.5 to about f/8.5 at a 1:1 magnification. Moreover, lens 50 is designed to minimize the effect of secondary color in the image plane. The front lens component has three lens elements including, in the following order, a first lens element of positive power, a second lens element of negative power cemented to the first lens element, and third lens element of positive power disposed between the second lens element and the diaphragm. The back lens component also has three similar lens components positioned so that lens 50 is symmetrical. Specifically, the first lens element in the front component is a double convex lens, the second lens element a double concave lens, and the third element a convex-concave lens element. For further details regarding lens 50, reference is made to U.S. Pat. No. 3,592,531 issued to McCrobie in 1971.

By way of example, projector 12 preferably is a modified Kodak Carosel 600 projector having an f/3.5 Ectaner C projection lens and a quartz lamp. The drive system for rotating successive individual slides is electrically coupled to the reproducing machine logic. In this manner, successive slides may be automatically indexed so that the resultant set of copies are collated. In addition, the drive system is automatically disabled at the point where the opaque original document is designed to be inserted. Thus, the copies not only correspond to collated copies of the transparencies but also include the opaque original document disposed in the correct position in the set of transparencies. In operation, the operator places a plurality of slides in the compartments of the cylindrical member. Thereafter, each slide is sequentially copied and the machine automatically de-energized at the point where the opaque original document should be placed. At this time, the operator places the opaque original document on the platen and forms a copy thereof. The machine then returns to the transparency copying mode and completes reproducing the set of transparencies. The foregoing is repeated a plurality of times to form a plurality of collated sets having both the transparencies and opaque original documents reproduced thereby.

Field lens 24 comprises a plurality of small light deflecting elements that provide a uniform distribution of light over a predetermined area. Preferably, there are 200 or more gratings per inch. The field lens converges the diverging light rays from lens 44 of slide projector 12 to insure that the light rays transmitted through platen 46 are substantially parallel. Though a Fresnel lens is preferably employed, other types of field lenses may be utilized in lieu thereof provided that they converge the diverging light rays to form substantially parallel light rays passing through platen 46.

As heretofore noted, screen 22 modulates the light image of the transparency to form a half-tone light image thereof. Preferably, screen 22 includes a plurality of spaced, opaque dots disposed on a substantially transparent sheet. The spacing between adjacent dots determines the quality of the resulting copies. A fine screen size generally results in a more natural or higher quality copy. Preferably, screen 22 has a plurality of equally spaced, soft gray square dots comprising about 85 dots per inch. However, this may range from about 65 to about 300 dots per inch. The foregoing is only limited by the optical system and the desired resolution. A suitable dot screen for positioning on the platen is manufactured by Caprock Corporation and may be a negative screen. An optical system employing such a screen for reproducing transparencies is described in copending application Ser. No. 540,617 filed in 1975. One skilled in the art will appreciate the screen may also be a suitable line screen rather than a dot screen.

With continued reference to FIG. 2, after the electrostatic latent image is recorded on photoconductive surface 38, drum 36 rotates to development station C. At development station C, three individual developer units, generally indicated by the reference numeral 60, 62 and 64, respectively, are arranged to render visible the electrostatic latent image recorded on photoconductive surface 38. Preferably, each of the developer units are of a type generally referred to in the art as "magnetic brush developer units". A typical magnetic brush developer unit employs a magnetizable developer mix which includes ferro-magnetic area granules and heat settable thermoplastic toner particles. The toner particles are triboelectrically attracted to the carrier granules. In operation, the developer mix continually brought through a directional flux field forming a chain-like array of fibers extending outwardly from the developer roll of the respective developer unit. This chain-like array of fibers is frequently termed a brush. The electrostatic latent image recorded on photoconductive surface 38 is rotated into contact with the brush of developer mix. Toner particles are attracted from the carrier granules to the latent image. Each of the developer units contain appropriately colored toner particles. For example, a green filtered light image is developed by depositing magneta toner particles thereon. Similarly, a red filtered light image is developed with cyan toner particles and a blue filtered light image with yellow toner particles. A development system of this type is described in U.S. Pat. No. 3,854,449 issued to Davidson in 1974.

After the single color electrostatic latent image is developed, drum 36 rotates to transfer station D. At transfer station D, the toner powder image adhering electrostatically to photoconductive surface 38 is transferred to a sheet of support material 66. Support material 66 may be a sheet of paper or plastic material. Transfer station D includes corona generating means, indicated generally by the reference numeral 68, and a transfer roll, designated generally by the reference numeral 70. Corona generator 68 is excited with an alternating current and arranged to pre-condition the toner powder image adhering electrostatically adhering to photoconductive surface 38. In this manner, the preconditioned toner powder image will be more readily transferred from the electrostatic latent image recorded on photoconductive surface 38 to support material 66 secured releasably on transfer roll 70. Transfer roll 70 recirculates support material 66 and is electrically biased to a potential of sufficient magnitude and polarity to attract electrostatically the pre-conditioned toner particles from the latent image recorded on photoconductive surface 38 to support material 66. Transfer roll 70 rotates in the direction of arrow 72, in synchronism with drum 10, to rotate support material 66 in registration with the toner powder image developed on photoconductive surface 38. This enables successive toner powder images to be transferred to support material 66 in superimposed registration with one another. U.S. Pat. No. 3,838,918 issued to Fisher in 1974 discloses a suitable transfer system of this type.

Prior to proceeding with the remaining processing stations, the sheet feeding apparatus will be briefly described. Support material 66 is advanced from a stack 74 disposed on tray 76. Feed roll 78, in operative communication with retard roll 80, advances and separates the uppermost sheet from stack 74. The advancing sheet moves into chute 82 which directs it into the nip between register rolls 84. Register rolls 84 align and forward the sheet to gripper fingers 86 mounted on transfer roll 70 which secures support material 66 releasably thereon. After the requisite number of toner powder image have been transferred to support material 66, gripper fingers 86 release support material 66 and space it from transfer roll 70. As transfer roll 70 continues to rotate in the direction of arrow 72, stripper bar 88 is interposed therebetween. Support material 66 then passes over stripper bar 88 onto endless belt conveyer 90. Endless belt conveyer 90 advances support material 66 to fixing station E.

At fixing station E, a fuser, indicated generally by the reference numeral 92, generates sufficient heat to permanently affix the multi-layered powder image to support material 66. A suitable fusing device is described in U.S. Pat. No. 3,781,516 issued to Tsilibes et al in 1973. After the fixing process, support material 66 is advanced by endless belt conveyers 94 and 96 to catch tray 98 permitting the machine operator to remove the finished color copy from the printing machine.

Although a preponderance of the toner particles are transferred to support material 66, invariable some residual toner particles remain adhering to photoconductive surface 38 after the transfer process. These residual toner particles are removed from photoconductive surface 38 at cleaning station F. Cleaning station F includes a corona generating device (not shown) for neutralizing the electrostatic charge remaining on the residual toner particles and photoconductive surface 38. The neutralized toner particles are then cleaned from photoconductive surface 38 by a rotatably mounted fibrous brush 100 in contact therewith. A suitable brush cleaning device is described in U.S. Pat. No. 3,590,412 issued to Gerbasi in 1971.

It is believed that the foregoing description is sufficient for purposes of the present application to illustrate the general operation of an electrophotographic printing machine incorporating the features of the present invention therein.

Referring now to FIG. 3, the specific mode of operation will be discussed. Initially, the machine operator sets the desired number of copies, i.e. sets, on dial 102, the number of transparencies to be reproduced on dial 104 and the location of the opaque original document on dial 106. For example, if five transparencies are being reproduced and one opaque original document, with the opaque original document being located after the third transparency, the five transparencies will be initially placed in compartment 16 of cylindrical member 14. In addition, if four ordered sets are designed to be reproduced from the foregoing, the operator will set dial 102 at four, i.e. the number of copies, dial 104 at five, i.e. for the number of transparencies, and dial 106 at three, i.e. the location of the opaque original document. Thereafter, the operator will depress print buttom 108. At this time, the printing machine control logic in association with control logic 110 will program the movement of cylindrical member 16 so that slide projector 12 projects successive light images of each color transparency. However, after the third transparency is projected, indexing motor 112 is disabled and the opaque original document positioned on the platen. At this time, the machine operator once again depresses print button 108 and a copy of the opaque original document is interposed with the copies of the transparencies. Thereafter, the control logic 110 switches the printing machine back to the transparency copying mode. Projector 12 projects successive light images of the next two transparencies onto photoconductive drum of the electophotographic printing machine. In this way, the next successive transparencies are reproduced as copies thereof. Thus, six copies in each set are obtained, five copies of transparencies and one copy of an original document with the opaque original document being located after the copy of the third transparency. The foregoing process is repeated four times producing four collated sets of copies. In this manner, the sets of copies are in an ordered sequence. Cylindrical member 14 acts as a storage container for the various slides. Control logic 110 regulates the actuation of indexing motor 112 so as to rotate cylindrical member 14 at the appropriate time. For example, the slide in compartment 16(*a*) is initially reproduced. Thereafter, indexing motor 112 is actuated by the control logic to advance compartment 16(*b*) into operative communication with the projector of slide projector 12 after the first copy of the slide in compartment 16(*a*) has been obtained. Similarly, after the first copy of the slide in compartment (1)6*b* has been obtained, indexing motor 112 is again actuated by control logic 110 to rotate cylindrical member 14 such that the slide in compartment 16(*c*) is in operative communication with the projection system of projector 12. At this time, control logic 110 disables indexing motor 114 permitting the machine operator to place an opaque original document on platen 46. After print buttom 108 is energized, a copy of the opaque original document is interposed with the copies of the transparencies. In addition, control logic 110 reactivates indexing motor 112 so that the next successive slide in compartment 16(*d*) of cylindrical member 14 will be in communication with the projection system of slide projector 12. The foregoing is repeated for the total number of slides and opaque original documents desired. After the first set of copies has been obtained, the cycle is repeated for the next successive set of copies. In this manner, the resultant copies are in an ordered sequence and the requisite number of sets are obtained thereby. The foregoing is achieved by setting dial 102 at the number of copies to be reproduced, dial 104 at the required number of transparencies, and dial 106 at the location of the opaque original document. Thereafter, print button 108 is depressed and the previously described sequence of events occurs. Referring now to FIG. 4, the details of the logic scheme will be discussed hereinafter.

An exemplary logic diagram for reproducing three sets having three transparencies and one opaque original document located after the second transparency is shown in FIG. 4. One skilled in the art may readily expand this as required. Initially, the number of copies or sets is set on dial 102 which loads buffer register 114. Similarly, dialing the number of transparencies on dial 104 loads buffer register 116. Finally, dialing the location of the opaque original document on dial 106 loads buffer register 118. Activation of print button 108 initiates the cycle. Timing pulse T1 is generated when print button 108 is activated. During timing pulse T1 AND gates 120, 122 and 124 are high and load output register 126. At this time, the signal from AND gate 128 is low. Inverter 130 changes the signal from and gate 128 to high and AND Gate 132 has a high output shifting the output content of register 126 one bit. This bit activates AND gate 134 and the signal therefrom is high. A high signal from AND gate 134 activated AND gate 136, 138 and 140 to generate a high signal loading register 142. During timing pulse T2, buffer register 118 develops a signal to AND gates 144 and 146 and AND gate 142 remains low inasmuch as buffer register 118 has been loaded for only two places, i.e. the opaque original document is located after the second transparency. Thus, output register 148 is loaded with signals from AND gates 144 and 146. During timing pulse T2, AND gate 152 is high shifting register 148 one bit. The signal from register 148 in conjunction with timing pulse T2 causes AND gate 154 to be high developing a signal which shifts output register 142. This bit activates AND gate 128. The output signal from AND gate 128 is high producing a low signal from inverter 130 inhibiting AND gate 132. The output signal from AND gate 128 also activates AND gate 156 producing a pulse therefrom which is converted to an analog signal by digital to analog converter 158. Amplifier 160 amplifies this signal which actuates indexing motor 112. Indexing motor 112 advances the next successive compartment 16 into communication with the projection system of slide projector 12. In this way, the next successive slide may be copied. AND gate 132 is inhibited until AND gate 128 develops a low signal. This will occur when output register 142 is unloaded, or, when AND gate 154 is low. AND gate 154 will be low when output register 148 is unloaded. Output register 148 will be unloaded after the second transparency has been copied. At this time, AND gate 154 is low and output register 142 is inhibited. Register 142, at this time, is not unloaded. It will merely not count another pulse. This disables indexing motor 112 since AND gate 156 is low. At this time, the machine operator places the opaque original document on the platen of the printing machine and depresses print button 108. Actuation of print button 108 causes switch 162 to connect AND gate 154 to the output signal as well as T2. This activates AND gate 154. This once again activates output register 142 shifting it one pulse. Output register 142 will now be unloaded sequentially producing copies of the remaining transparencies. When output register 142 is unloaded, AND gate 128 is low. The signal therefrom is inverted by inverter 130, actuating AND gate 132 to produce a high signal. This signal shifts the output content of register 126 a second bit repeating the previous cycles for all of the slides and the opaque original document to form a second set of copies. This process is repeated until register 126 is unloaded. At this time, the copying cycle is completed. When the copying cycle is completed, the machine logic processes the signal from AND gate 134 inactivating the printing machine 10.

In recapitulation, the electrophotographic printing machine heretofore described is adapted to reproduce successive ordered copies of slides and an opaque original document interposed therebetween. This is achieved automatically by pre-collating the slides prior to their reproduction and determining the location of the original documents therebetween. The output from the printing machine is a plurality of collated sets of copies of slides and at least one opaque original document. Thus, the printing machine creates a plurality of collated sets of copies by pre-collating the slides and defining the location of the opaque original document therebetween. This is achieved by automatically indexing each slide after a copy thereof has been made and disabling the foregoing mechanism to permit the machine operator to reproduce the original opaque document at the prescribed location. Thereafter, the remaining slides are automatically reproduced. This sequence of events is repeated for the desired number of sets.

Thus, it is apparent that there has been provided, in accordance with the present invention, an electrophotographic printing machine that fully satisfies the objects, aims and advantages hereinbefore set forth. While this invention has been discussed in conjunction with a specific embodiment thereof, it is evident that many alternatives, modifications and variations will become apparent to those skilled in the art in light of the foregoing description. Accordingly, it is intended to embrace all such alternatives, modifications, and variations that fall within the spirit and broad scope of the appended claims.

What is claimed is:

1. An electrostatographic printing machine, including:

means for storing a plurality of transparencies;

means for supporting at least one opaque original document;

means for reproducing transparencies and opaque original documents to form copies thereof;

means for advancing each transparency into operative communication with said reproducing means in a preselected sequence; and means for switching said reproducing means from the transparency copying mode to the opaque original document copying mode in response to a pre-determined number of transparencies being copied so as to form a set of ordered copies having copies of the transparencies and opaque original documents.

2. A printing machine as recited in claim 1, wherein said storing means includes a cylindrical member having a plurality of radially extending compartments arranged to hold a transparency therein.

3. A printing machine as recited in claim 2, wherein said advancing means includes:

an indexing motor having said cylindrical member mounted rotatably thereon; and programming means, coupling said reproducing means to said indexing motor, for actuating said indexing motor in response to said reproducing means completing the copying of one of the transparencies to advance the next successive transparency into communication with said reproducing means to form a copy thereof.

4. A printing machine as recited in claim 3, wherein said switching means includes operator settable means for decoupling said indexing motor from said reproducing means after the pre-selected number of transparencies have been copied and actuating said reproducing means to form a copy of the opaque original document positioned on said supporting means.

5. A printing machine as recited in claim 4, wherein said reproducing means includes:

a photoconductive member;

means for charging at least a portion of said photoconductive member to a substantially uniform level; and means, coupled to said cylindrical member, for projecting a light image of one of the transparencies onto the charged portion of said photoconductive member selectively dissipating the charge thereon to record an electrostatic latent image thereof.

6. A printing machine as recited in claim 5, wherein:

said supporting means includes a transparent platen member having the opaque original document disposed thereon; and said reproducing means includes means for exposing the charged portion of said photoconductive member to a light image of the original document disposed on said platen member for recording an electrostatic latent image thereon.

7. A printing machine as recited in claim 6, wherein said reproducing means includes means for filtering the light image of the transparency to form a single color light image thereof which irradiates the charged portion of said photoconductive member to record thereon a single color electrostatic latent image.

8. A printing machine as recited in claim 7, wherein said reproducing means includes means for modulating the light image of the transparency.

9. A printing machine as recited in claim 8, wherein said reproducing means includes a field lens interposed into the path of the transparency light image.

10. A printing machine as recited in claim 9, wherein said modulating means includes a screen interposed into the path of the transparency light image.

11. A printing machine as recited in claim 10, wherein said projecting means includes a slide projector arranged to project a light image of successive transparencies.

12. A printing machine as recited in claim 11, wherein said exposing means includes:

a light source arranged to illuminate the original document disposed on said platen member; and lens means for receiving the light ray transmitted from the original document and forming a light image thereof.

* * * * *